US008333055B2

(12) United States Patent
Thomasset

(10) Patent No.: US 8,333,055 B2
(45) Date of Patent: Dec. 18, 2012

(54) PROCESS FOR FILLING A SHRINKABLE CONTAINER

(75) Inventor: Jacques Thomasset, Vouvry (CH)

(73) Assignee: Aisapack Holding S.A., Vouvry (CH)

( * ) Notice: Subject to any disclaimer, the term of this patent is extended or adjusted under 35 U.S.C. 154(b) by 499 days.

(21) Appl. No.: 12/593,792

(22) PCT Filed: Feb. 24, 2008

(86) PCT No.: PCT/IB2008/050661

§ 371 (c)(1),
(2), (4) Date: Oct. 8, 2009

(87) PCT Pub. No.: WO2008/120115

PCT Pub. Date: Oct. 9, 2008

(65) Prior Publication Data

US 2010/0119743 A1 May 13, 2010

(30) Foreign Application Priority Data

Mar. 31, 2007 (EP) ..... 07105418
May 10, 2007 (WO) ..... PCT/IB2007/051772
May 29, 2007 (WO) ..... PCT/IB2007/052009

(51) Int. Cl.
*B65B 55/14* (2006.01)

(52) U.S. Cl. ..... 53/440; 53/432; 53/510

(58) Field of Classification Search ..... 53/440, 53/432, 485, 275, 84, 510
See application file for complete search history.

(56) References Cited

U.S. PATENT DOCUMENTS 2,978,336 A * 4/1961 Morrison ..... 426/393
4,450,878 A 5/1984 Takada et al.
4,696,580 A * 9/1987 Kameda ..... 374/162
5,251,424 A 10/1993 Zenger et al.
5,622,579 A * 4/1997 Tobias ..... 156/73.1
6,502,369 B1 * 1/2003 Andison et al. ..... 53/432
7,926,243 B2 * 4/2011 Kelley et al. ..... 53/440

FOREIGN PATENT DOCUMENTS

WO WO 2006/136706 A1 12/2006

OTHER PUBLICATIONS

International Search Report for PCT/IB2008/050661 mailed Nov. 6, 2008.
English Translation of Written Opinion (IPRP Chapter I) for PCT/IB2008/050661, mailed Nov. 6, 2008.

* cited by examiner

*Primary Examiner* — Sameh H. Tawfik
(74) *Attorney, Agent, or Firm* — Nixon & Vanderhye P.C.

(57) ABSTRACT

The invention relates to a process for filling a plastic container (1) having a high degree of molecular orientation with a liquid, which process comprises the following steps:

filling of the container (1) with a liquid at high temperature;

cooling the walls (5) of the container (1) during the filling step;

sealing of the container (1);

cooling of the walls (5) of the container (1) during the sealing step;

passive shrinkage of the container (1) following said sealing step; and cooling of the walls (5) of the container (1) following the shrinkage step.

The invention also relates to a device for implementing said process and to a container thus obtained.

4 Claims, 4 Drawing Sheets

PROCESS FOR FILLING A SHRINKABLE CONTAINER

This application is the U.S. national phase of International Application No. PCT/IB2008/050661 filed 24 Feb. 2008 which designated the U.S. and claims priority to European Patent Application No. 07105418.3 filed 31 Mar. 2007, International Patent Application Nos. PCT/IB2007/051772 filed 10 May 2007 and PCT/IB2007/052009 filed 29 May 2007, the entire contents of each of which are hereby incorporated by reference.

FIELD OF THE INVENTION

The invention relates to a process for filling a retractable container with a liquid product. The invention describes the filling of a product at high temperature in a plastic container, which shrinks under the effect of said high temperature. The process applies in particular to the filling of a PET bottle that has not undergone heat-setting with a product at above 60° C.

PRIOR ART

Polyethylene terephthalate (PET) bottles are used in many fields owing to their excellent properties of resistance lightness, transparency and organoleptic properties. These bottles are manufactured at a high production rate by biaxially stretching a preform in a mold.

However, although these bottles offer many advantages, they do have the drawback of deforming when their temperature is above 60° C. Filling these bottles with a product at a high temperature (85° C.) causes such distortions that said bottles become unfit for use. Several processes for remedying the aforementioned drawback and allowing PET bottles to be filled hot have been described in the prior art.

Heat-setting is considered to be the most effective process for improving the heat resistance of biaxially oriented PET bottles. The principle of this process, widely used in commercial operations, consists in subjecting the walls of the bottle to a heat treatment so as to increase the crystallization and thus improve molecular stability at high temperature. This principle may be applied in various ways by heat-setting processes and devices described in the prior art. One major advantage of heat-setting processes is that the filling processes do not have to be modified, the heat-setting of the bottle being carried out during manufacture of said bottle.

However, the bottles that have undergone a heat treatment so as to allow filling with a liquid at high temperature have a number of drawbacks.

A first drawback lies in the fact that only specific grades of polyethylene terephthalate may be used. These grades are more difficult to produce and increase the cost of the container.

A second drawback is due to the reduction in bottle production rate because the heat-setting process slows down the blow molding cycle.

A third drawback is due to the weight of these bottles. When a bottle is filled with a hot liquid, this results, after cooling, in a negative pressure inside the bottle, said negative pressure having the effect of randomly deforming the walls of the bottle. The most widely used process for offsetting the negative pressure in the bottle is to add compensating panels which allow the bottle to deform in a controlled manner. However, bottles having compensating panels are more rigid and therefore heavier. As a result, more material than is strictly necessary for good preservation of the product is used.

In addition, compensating panels detract from the appearance of the container, making it less attractive to the user.

Patent applications WO 2004/106175 and WO 2005/002982 provide a design of the bottom of the bottle, which can be formed and avoids the use of lateral compensating panels.

Patent application FR 2 432 991 provides a process for filling a PET bottle that avoids the use of bottles that have undergone heat-setting. This process consists in cooling the outer walls of the bottle so as to avoid any deformation of the bottle during the filling cycle. According to that process, the cooling of the outer walls of the bottle may be interrupted when it is no longer essential to prevent said bottle from deforming. This process prevents the bottle from deforming during filling. However, this process does not obviate the use of compensating panels for counteracting the negative pressure in the bottle after cooling.

U.S. Pat. No. 5,251,424 also provides a process for filling a PET bottle that avoids the use of bottles that have undergone heat-setting. This process consists in filling the bottle with a liquid at high temperature and in adding a dose of liquid nitrogen before closure. Vaporization of the nitrogen generates pressure in the bottle that prevents it from shrinking. In addition, this process obviates the use of lateral compensating panels, since the nitrogen maintains sufficient pressure in the bottle to compensate for the change in volume of the liquid. In theory, the process described in U.S. Pat. No. 5,251,424 ought to allow conventional PET bottles to be used and a cost reduction to be achieved. However, in practice this process is very difficult to implement. The overpressure generated immediately on closing the bottle, the walls of which are at high temperature, results in an immediate and undesirable deformation of the container.

To remedy the drawbacks of U.S. Pat. No. 5,251,424, U.S. Pat. No. 6,502,369 provides a similar process, but with a bottle being filled in the cavity of a mold. This process consists in introducing the bottle into the cavity of a mold, then filling the bottle with a liquid at high temperature and in adding a dose of liquid nitrogen after closure. Vaporization of the nitrogen presses the wall of the container against the wall of a cooled mold. This process makes it possible to obtain conventional bottles filled at high temperature, however the complexity of the filling machine, which consists in filling each bottle in the cavity of a mold, makes this process difficult to use.

The processes provided in the prior art all have a common point, which consists in preventing the container from shrinking due to the effect of temperature. The volume of the container before and after filling is therefore the same.

GENERAL PRESENTATION OF THE INVENTION

Unlike the processes proposed in the prior art, the principle of the invention consists in exploiting the shrinkage properties of the container during the filling phase and consequently results in a change in volume of said container. The volume of the container filled according to the invention is smaller after filling.

The process according to the invention consists in using the shrinkage properties of the containers in a controlled manner when they are filled at high temperature (generally 85° C. in the case of PET bottles). This process is advantageous as it makes it possible firstly to use containers that have not undergone a prior heat treatment and secondly to avoid or limit the creation of a negative relative pressure in the container after cooling.

One object of the invention is in particular a process as defined in the claims. The invention also relates to a device and to a container as are defined in the claims.

The process described in the invention makes it possible to fill containers that shrink when they are exposed to the high temperature at which they are filled with the product. These plastic containers have a molecular orientation that shrinks at said high temperature. The invention applies in particular to the filling of biaxially oriented PET containers, such as bottles. The invention also applies to the high-temperature filling of plastic containers produced from films, said films shrinking under the effect of said high temperature.

The process according to the invention also makes it possible to generate a positive relative pressure inside a shrinkable container. The invention consists in shrinking a filled and hermetically sealed container by heating the wall of said container. The process according to the invention makes it easier to grip thin-walled containers and to increase their resistance to vertical compression.

BRIEF DESCRIPTION OF THE DRAWINGS

The invention will be better understood with the aid of the following figures:

FIGS. 1 and 2 describe the general concept of the first embodiment of the invention.

FIG. 1 shows the container immediately after being filled and stoppered, the product inside the container being at high temperature.

FIG. 2 shows the container at the end of the process for filling the product. The volume of the container is lower owing to the shrinkage of the container.

FIGS. 3 to 8 show the various steps of the method.

FIG. 3 shows a container before filling.

FIG. 4 illustrates the filling of the container with the product at high temperature.

FIG. 5 shows the sealed closure of the container.

FIG. 6 illustrates the shrinkage of the container, the product being at high temperature. The pressure inside the container compresses the volume of gas in the head space.

FIG. 7 shows the cooling of the container and the return to ambient temperature of the product.

FIG. 8 shows the container cooled to ambient temperature. The expansion of the volume of gas in the head space compensates for the thermal contraction of the product.

FIG. 9 illustrates local cooling of the container during the filling process.

FIGS. 10 and 11 illustrate the hot-filling of a container made up from a film that shrinks at said high temperature.

FIG. 10 shows the container just after being filled with the product at high temperature and hermetically sealed.

FIG. 11 illustrates the geometry of the shrunk container.

FIG. 12 illustrates the heating for creating a local shrinkage of the walls of the container and thus generating pressure in the container.

FIG. 13 shows that the volume of the container after shrinkage is lower than the initial volume.

DETAILED DESCRIPTION OF THE INVENTION

The invention consists in using the shrinkage properties of a container when it is heated to high temperature. In the description of the invention, the term "high temperature" denotes a temperature for initiating the shrinkage of the container, as opposed to the term "low temperature" which denotes a temperature below the shrinkage temperature.

The shrinkage properties of a container depend strongly on the manufacturing processes and more precisely on the molecular orientation induced during said manufacture. For example, a container such as a PET bottle, manufactured by biaxially stretching a preform in a mold, shrinks strongly when it is heated to high temperature. Other containers, such as containers made from film, may also exhibit similar shrinkage properties.

The first embodiment of the invention consists in using the shrinkage of the container when filling it with a product at high temperature, said product having the effect of heating the walls of the container and causing it to shrink. The key point of the invention consists in using the shrinkage of the container in a controlled manner so as to limit the deformations and at least partly remedy the negative relative pressure that usually rises in the container after cooling.

Figure 1:
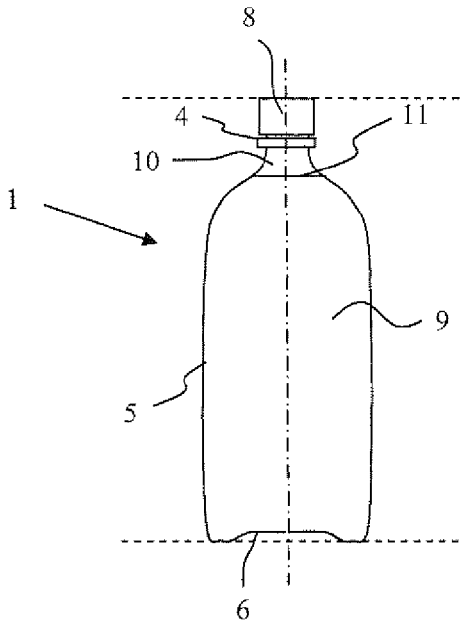
FIGS. 1 to 11 describe a first embodiment of the invention.
Figure 2:
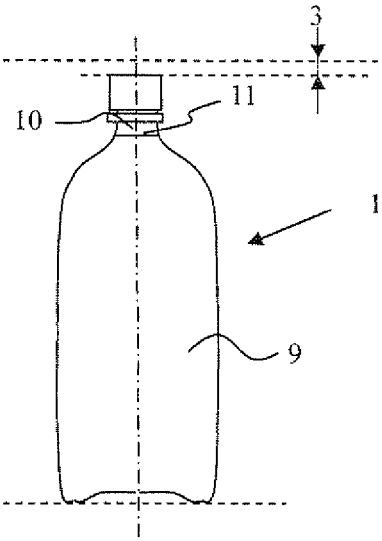

The general principle of the invention is presented in FIGS. 1 and 2.

FIG. 1 shows the initial geometry of the container 1, which comprises a neck 4, a cylindrical body 5 and a bottom 6. The walls of the container undergo considerable shrinkage when it is heated to high temperature. FIG. 1 shows the container 1 filled at high temperature with a product 9 and hermetically sealed with a stopper 8. The container is also filled with gas 10 in the head space, said gas possibly being air. The fill level 11, which defines the relative volume of product at high temperature and of gas inside the container at the moment when it is closed, is precisely defined. Before hermetically sealing the container, it is generally preferable to prevent the container from shrinking. This is why when the container shrinks rapidly, it may be advantageous to employ means for stopping the shrinkage before said hermetic sealing.

FIG. 2 shows the container 1 and its content after cooling to ambient temperature. The container shrank during high-temperature filling with the product. The change in volume of the container is shown schematically by the change in height 3 of the container. The change in volume may be associated with a change in height, with a change in diameter or a change in geometry. In all cases, the change in volume is created by the walls of the container shrinking. Certain parts of the container do not shrink, such as for example the neck 4 which provides a seal with the stopper. FIG. 2 also shows the volume of product 9 inside the container, said volume having decreased owing to the contraction of the product 9 upon cooling down to ambient temperature. According to the invention, the shrinkage of the walls of the container after being hermetically sealed makes it possible to at least partly compensate for the contraction of the product upon cooling down. It is often advantageous to allow the container to shrink sufficiently to generate a relative pressure inside the container equal to or greater than zero when the product is at ambient temperature. Thus, the use of containers with compensating panels is no longer necessary.

FIGS. 3 to 8 illustrate the filling of PET containers and describe each step of the process.

Figure 3:
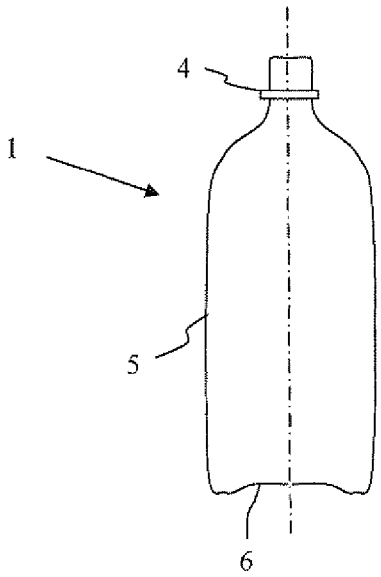

FIG. 3 shows a PET container 1 comprising a neck 4, side walls 5 and a bottom 6. There is a high degree of molecular orientation in the walls of this container, so that said walls shrink at high temperature. In the case of a PET container made by biaxial stretching, said high temperature, which corresponds to the temperature at which the molecular mobility becomes sufficient to allow shrinkage, is above 60° C. In general, hot-filling temperatures are at least 85° C. so as to guarantee sufficient preservation properties. At these temperatures, the walls of the PET container shrink considerably and rapidly.

Figure 4:
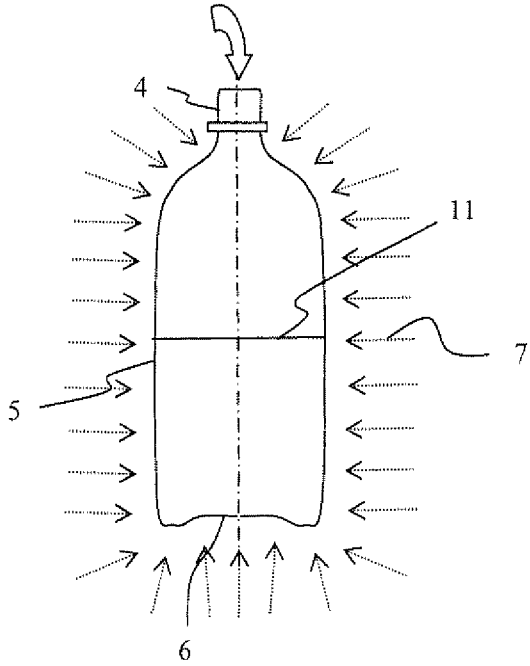

FIG. 4 shows the filling of the container 1 with a product 9 at high temperature, said container shrinking at said high temperature. In general, it is necessary to cool the outer walls of the container 1 so as to prevent the container from shrinking during said filling operation. Means 7 cool the outer wall of the container at the neck 4, at the side walls 5 and at the bottom 6. In certain cases, partial cooling of the container walls is sufficient. To give an example, the outer wall of the bottle may be cooled with a low-temperature fluid sprayed onto the container. Filling is carried out rapidly so as to prevent the container from shrinking under the effect of the temperature. The container 1 is not completely filled with product 9 so as to leave a sufficient volume of gas in the head space. This gas is generally air, however it may be advantageous in certain cases to use specific gases, such as nitrogen or carbon dioxide. The addition of specific gases in the head space usually takes place immediately after filling and before the container is hermetically sealed.

Figure 5:
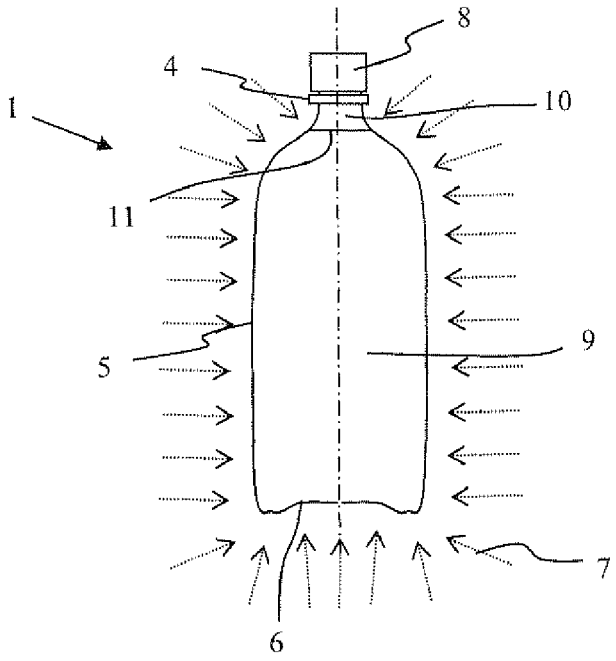

FIG. 5 illustrates the hermetic sealing of the container 1 after being filled at high temperature with the product 9. The fill level 11 at the moment of hermetic sealing defines the amount of filling, that is to say the relative proportions of product 9 and gas 10 in the container. The degree of filling plays an important role in the invention as it defines the residual pressure in the container after cooling. This aspect will be better understood after the various steps of the process have been completely explained. During the step of hermetically sealing the container illustrated in FIG. 5, it is often preferable to continue to cool the outer wall of the container. The sealing operation consists in applying a stopper 8 to the neck 4 so as to hermetically seal the container 1. At the moment of sealing, the relative pressure inside the container is zero. Cooling means 7 prevent the container from rising too high in temperature and from shrinking. The sealing step illustrated in FIG. 5 is carried out rapidly using known methods. To give an example, the sealing may be effected by stoppering or by welding.

Figure 6:
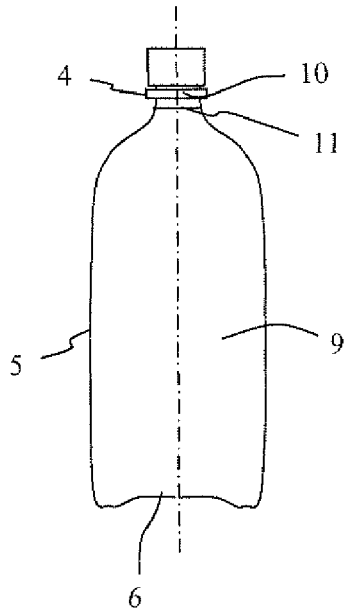

FIG. 6 illustrates the key step in the filling process, during which the container shrinks in a controlled manner. In this step, the walls of the container shrink under the effect of the temperature and reduce the volume of said container. This results in a rise in pressure in the container, which is hermetically sealed. This rapid rise in pressure has the effect of compressing the volume of gas inside the container.

The step during which the container illustrated in FIG. 6 shrinks is initiated when the product is still sufficiently hot to cause shrinkage. In general, the shrinking takes place immediately after sealing, when the product is still at high temperature. When the temperature of the product is too high, it is desirable to cool the product and the container down to a suitable shrinkage temperature. This is because too high a shrinkage temperature causes undesirable deformation of the container. For example, when filling a PET container at 100° C., it may be advantageous for shrinkage to take place at 80° C. It is therefore necessary to cool the product and the container down to 80° C. before effecting the shrinkage.

The shrinkage is initiated at a temperature high enough to generate pressure inside the container, but low enough to prevent undesirable deformation of said container. In the case of PET containers, this temperature is generally between 65° C. and 100° C. However, a shrinkage temperature between 75° C. and 90° C. is advantageous.

The shrinkage of the container is usually small and not easy to see with the naked eye. The shrinkage depends on the container, on the degree filling, on the shrinkage temperature and the shrinkage time. The degree of shrinkage has a direct influence on the residual pressure, that is to say on the relative pressure in the container after cooling. In general, a liquid product filled at high temperature contracts by between 2% and 5% upon cooling. For example, water upon cooling from 85° C. to 20° C. sees its volume reduced by about 3%. The reduction in volume depends on the change in temperature and on the properties of the product. In theory, a shrinkage of the container equal to the change in volume of the product results in a zero residual pressure. When the shrinkage of the container is larger than the change in volume of the product, the residual pressure is positive. Conversely, when the shrinkage of the container is smaller than the change in volume of the product, the residual pressure is negative. In practice, the temperature of the gas when the container is being hermetically sealed may have an influence on the residual pressure. It is advantageous to trap a low-temperature gas at the moment when the container is being hermetically sealed.

The geometry of the container has a direct influence on the shrinkage in volume of said container. It has been observed that a container of small volume and high wall thickness is favorable for generating a high shrinkage pressure.

The conditions under which said container are manufactured also have a great influence on the shrinkage. In the case of PET containers, it has been observed that a low biaxial stretching temperature results in containers that shrink considerably under the effect of temperature. Conversely, a high biaxial stretching temperature results in lower shrinkage forces. The stretching temperature can be used to optimize the shrinkage force and shrinkage rate of the container.

The degree of filling, defined by the ratio of the product volume to the container volume at the moment when the latter is hermetically sealed, has an influence on the shrinkage of the container. When the degree of filling is too high, the container shrinks little and leads to a negative residual pressure in the container. Conversely, when the degree of filling is too low, the container shrinks greatly and results in undesirable deformation of said container. The degree of filling must be adjusted according to the desired residual pressure. Usually, the degree of filling is chosen to be between 85% and 98%, preferably between 90% and 96%.

FIG. 6 illustrates the shrinkage mechanism. Under the effect of the high temperature of the product 9, the container shrinks and compresses the volume of gas 10 within the head space. The compression of the gas is displayed by the change in fill level 11. The rate of shrinkage of the container is generally quite rapid and depends on the shrinkage temperature. Preferably, the shrinkage time is less than 5 minutes and preferably less than 3 minutes. The shrinkage is initiated when the product is still at high temperature.

Figure 7:
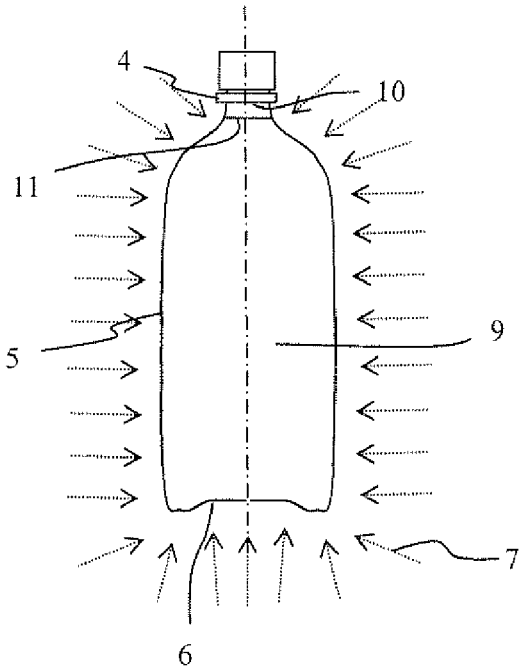

FIG. 7 shows the step of cooling the container and its content down to ambient temperature. Means 7 cool the outer wall of the container. For example, water is sprayed onto the container so as to cool it, or else the container may be immersed in a bath of cold water. It is often advantageous for the container to be rapidly cooled down to a temperature at which the molecular chains of said container are stable, that is to say the temperature at which the container does not shrink. For a biaxially stretched PET container, this temperature is about 60° C. Below this temperature, the container may be cooled more slowly, by natural convection with the ambient air.

Figure 8:
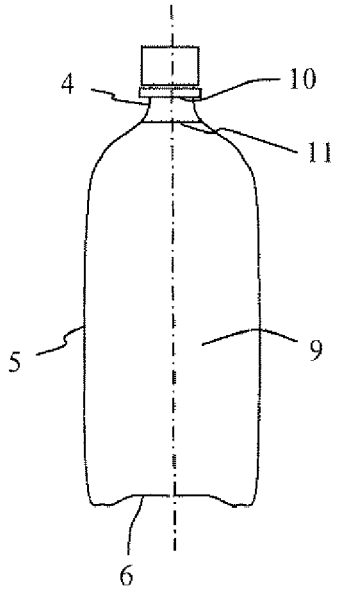

FIG. 8 shows the container after cooling down to ambient temperature. The cooled container differs from the container before filling illustrated in FIG. 3; said volume of the container being reduced owing to its shrinkage during filling. In a preferred method, the relative pressure inside the container is equal to or greater than zero. In this preferred method, the container does not have compensating panels, said panels being unnecessary since the pressure inside the container is positive or zero. The degree of crystallization of the side walls of the container is less than 30% and usually between 15 and 25%.

In the description of the invention, the container is always shown with the neck 4 facing upward. It is common practice to invert the container after it has been hermetically sealed, so as to make the entire internal surface of the container sterile. Inverting the container allows the internal surface of the neck 4 and of the stopper 8 to be sterilized, said internal surface being brought into contact with the high-temperature product during the inversion. By sterilizing the container, thanks to the high temperature of the product, it is possible to kill the germs that may remain on the internal wall of the container and the product is optimally preserved. The sterilization of the container is advantageously carried out at the same time as the shrinkage of the container.

The invention allows containers to be filled at high temperature very precisely and reproducibly. Reproducibility requires the use of containers produced in an identical manner. In the case of PET containers manufactured by blow molding a preform, it is important for example to control the blow molding temperature, this having a great influence on the shrinkage properties. During filling with the product, it is important to fill all the bottles in the same manner. By controlling the process for manufacturing the containers and for filling them, it is possible to ensure very stable production.

The invention allows PET containers to be filled at 100° C. without heat-setting them. Filling with a product at 100° C. may require optimum cooling means during the steps of filling and hermetically sealing the container. According to the invention, the container may be filled and shrunk at 100° C., or the container may be filled at 100° C. and shrunk at a lower temperature, such as for example 85° C.

When the filling takes place at a particularly high temperature, it may be advantageous to use containers in which only certain parts have undergone a heat treatment. For example, it is advantageous to use a PET container of which only the neck has been crystallized, so as to prevent that part of the container from shrinking. One particularly advantageous bottle has a neck whose degree of crystallization is greater than that of the side walls.

The bottom of the container is designed to withstand both the temperature and the pressure that are established in the bottle during shrinkage. A bottom of petaloid type, even if its degree of crystallization is low, proves to be particularly suitable. A highly stretched bottom, the geometry of which is close to that obtained with free blowing (bubble geometry) is also very suitable for the filling process.

More generally, it may be advantageous to create containers having preferential shrinkage zones. These preferential shrinkage zones may be created during manufacture of said container, by generating higher molecular orientation in said shrinkage zones. For PET containers manufactured by blow molding, preferential shrinkage zones may be created by varying the stretch ratio and the stretch temperature. A low blow molding temperature or a high stretch ratio allows the shrinkage to be increased.

Figure 9:
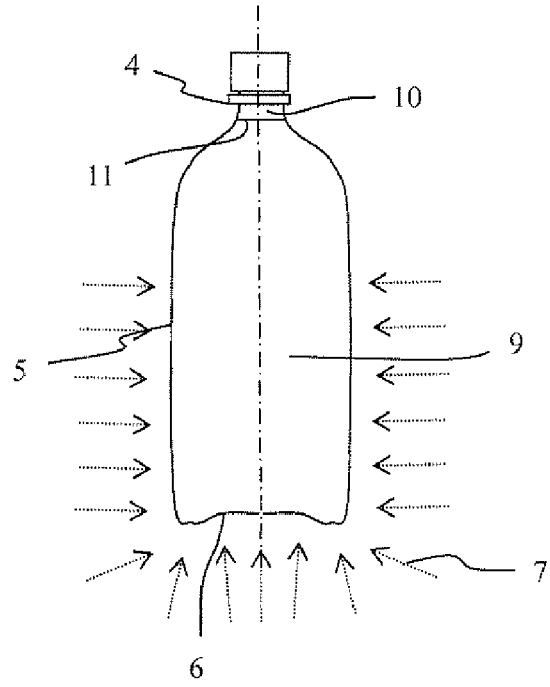

FIG. 9 illustrates another method for having preferential shrinkage zones. This method consists in stopping certain parts of the container from shrinking during the shrinkage step. Means 7 cool the lower part of the container and thus prevent this part of the container from shrinking. The upper part of the container, which is not cooled, shrinks.

The first method of implementing the invention is particularly suitable for the high-temperature filling of biaxially oriented PET containers such as bottles. The invention makes it possible to obviate the use of bottles having undergone a heat-setting treatment. It allows bottles without compensating panels to be used and filled at temperatures as high as 100° C. The invention also allows the use of thin-walled bottles, said thin wall being less than 0.3 mm in thickness. Finally, the invention makes it possible to obtain bottles with a slight residual internal pressure, said pressure being generated by the shrinkage of the container during the hot-filling process.

Figure 10:
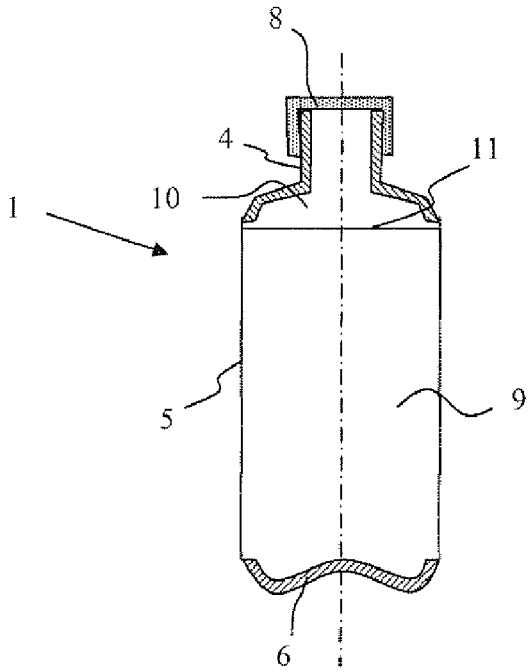
Figure 11:
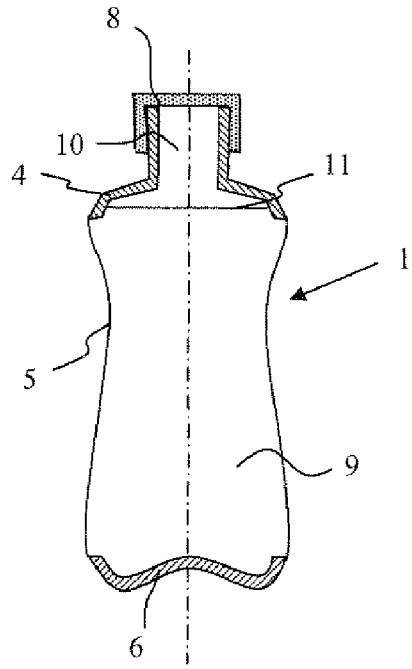

The invention may be used for the high-temperature filling of a large variety of containers that shrink at said high temperature. Containers manufactured from films may be used. FIGS. 10 and 11 show the filling of a container made from a film with a liquid at high temperature.

FIG. 10 illustrates the step of hermetically sealing the container. The container 1 comprises a tubular body 5 joined to a neck 4 and to a bottom 6, said tubular body 5 being made from a film that shrinks under the effect of said high temperature. Said film, comprising one or more layers, has a sufficiently high degree of molecular orientation to generate the shrinkage properties. Said film has not undergone heat-setting, which would eliminate the shrinkage properties. The joins between the film 5 and the ends 4 and 6 may be formed by welding. Said ends 4 and 6 generally have a greater thickness than the tubular body 5 and may be manufactured by molding. According to a preferred embodiment, the ends 4 and 5 forming the neck and the bottom of the container respectively do not contract under the effect of said high temperature. The container 1 is filled with a high-temperature product 9 and hermetically sealed with a stopper 8. A volume of gas 10 is trapped in the headspace during hermetic sealing. As illustrated in FIG. 10, the outer wall of said container is not necessarily cooled during hot filling and hermetic sealing. Cooling may be necessary to limit or prevent shrinkage of the container before hermetic sealing.

FIG. 11 illustrates the shrunk container 1 after the container and its contents have cooled to ambient temperature. Only the tubular body 5 has shrunk under the effect of the high temperature. After cooling, the residual relative pressure in the container 1 is positive or zero. A slight overpressure in the container is favorable for improving means of gripping said container and increasing its resistance to vertical compression.

However, it may happen that the shrinkage of the container is not sufficient to compensate for the change in volume of the product contained in the container. This is in particular the case of large-volume bottles for which the volume of gas trapped is small compared with the volume of product. This is also the case with bottles having very thin walls, which generate low shrinkage forces. Finally, this is the case for bottles having a high degree of filling so as to minimize the amount of oxygen trapped in the bottle. To avoid establishing a negative pressure in the bottle after it has been filled, it is proposed to add a step of heating the bottle using an external heat source during filling. The heating step allows the shrinkage to be activated at a precise moment or the amplitude of the shrinkage to be increased.

A first variant consists in at least partly heating the container immediately after it has been filled and hermetically sealed. The heating has the effect of increasing the shrinkage of the container and compressing the gas contained in the head space. Upon cooling, the gas under pressure expands.

In a second embodiment, the container is heated while the latter and its content have already started to cool. Preferably, the container is heated when the mean wall temperature is close to the glass transition temperature.

In a third variant, the container is heated when cooling has finished. The heating allows the walls of the container to shrink and creates a positive or zero relative pressure inside the container.

The heating of the container preferably takes place on the side walls. It may be advantageous to heat the walls of the container locally in a predefined zone, called the shrinkage zone.

Advantageously, the heating is rapid high-temperature heating so as to limit the heat-up of the product contained in the container. Heating by blowing hot air is advantageous. In general, the bottle shrinks uniformly around the axis of symmetry. By rotating the bottle about the axis of symmetry while the bottle is passing through the oven it is possible to obtain uniform shrinkage. Another method consists in using infrared lamps to cause the walls of the container to shrink.

Figure 12:
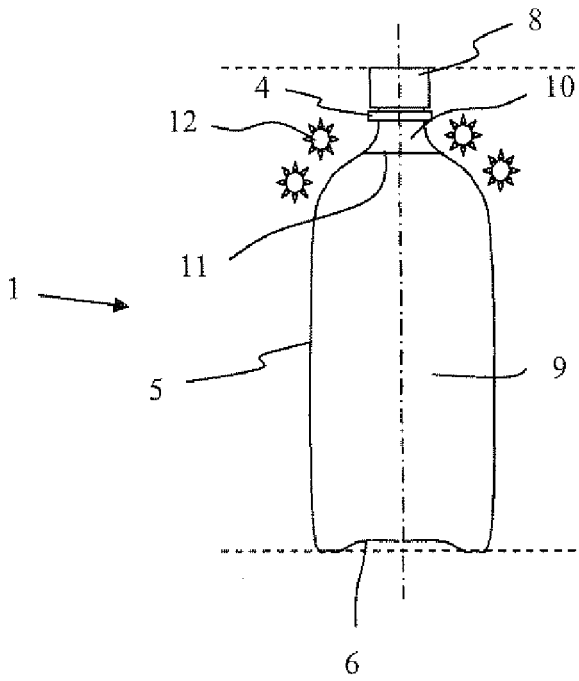
FIGS. 12 and 13 illustrate a second embodiment of the invention, which consists in generating an overpressure in a shrinkable container at high temperature and filled at low temperature.
Figure 13:
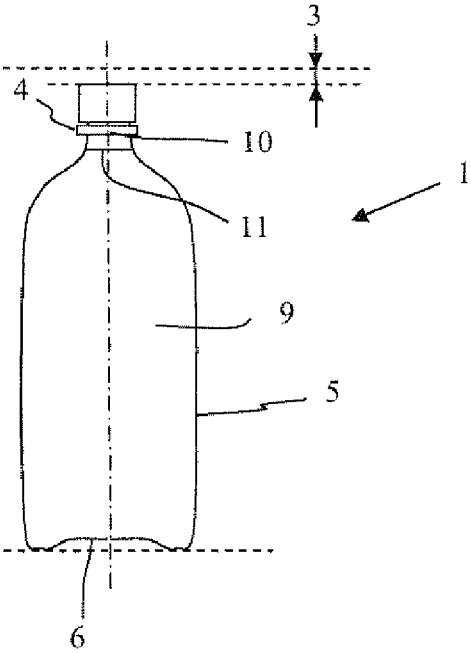

FIGS. 12 and 13 illustrate the second method of implementing the process, which consists in using the shrinkage properties to pressurize a container filled at a temperature below the shrinkage temperature. Pressurizing the container after filling is particularly useful when said container has walls of small thickness. The conventional method for generating this pressure consists in adding, after filling, a gas such as nitrogen into the head space. The change in state of the gas generates a slight overpressure, which improves the strength of the container and makes it easier to use it. The invention enables this overpressure to be generated without adding a specific gas into the head space.

FIG. 12 shows the container 1 filled with a product 9 at low temperature, said low temperature being below the shrinkage temperature of the container. A stopper 4 hermetically seals the container 1. A volume of air 10 is enclosed in the container and is located in a shrinkage zone of the container. Means 12 heat at least said shrinkable zone so as to slightly reduce the volume of said container and slightly compress the volume of air 10.

FIG. 13 illustrates the shrunk container. The reduction in height 3 serves to illustrate the change in volume of said container. The volume of air 10 in the container has decreased, which means that the air is slightly compressed. The invention is particularly advantageous for pressurizing PET containers such as bottles.

The invention, which consists in using the shrinkage properties of the container during filling, requires a design of the container that takes into account the shrinkage of the container during filling. The container must be designed so that the final volume corresponds to the desired volume. In general, the shrinkage of the container is between 1% and 20% and this shrinkage is preferably between 3% and 15%.

Example 1

The bottle has a weight of 24 grams and its bottom was of the petaloid type. Its initial volume was 543.2 ml. After filling at 90° C. using the operating method below, its volume became 508.7 ml. The bottle therefore shrank by 6.35% during filling. After cooling, the relative pressure inside the bottle was slightly positive.

The bottle was filled using the following operating method:

1. Provision of an empty bottle
2. Rinsing of the bottle
3. Transfer of the bottle onto the feedstation
4. Start of cooling of the outer wall of the bottle by spraying with water at 15° C.
   a. filling of the bottle with water at 90°
      i. filling time: 4 seconds
      ii. filling volume: 92% of the initial volume, i.e. 499.7 ml.
   b. transfer to the sealing station
      i. duration: 1 s
   c. sealed closure of the bottle
      i. duration of the stoppering: 1 s
5. End of cooling of the outer wall of the bottle
6. Shrinkage of the bottle in the open air
   i. shrinkage phase and sterilization
   ii. temperature of the ambient air: 20° C.
   iii. duration: 3 minutes
7. Rapid cooling of the bottle
   i. cooling by spraying with water at 15° C. until the container and its content have returned to ambient temperature.

Example 2

The bottle has a weight of 37.4 grams and its bottom was of the petaloid type. Its initial volume was 1064.2 ml. After filling at 88° C. using the operating method below, its volume became 1012.1 ml. The bottle therefore shrank by 4.9% during filling. After cooling, the relative pressure inside the bottle was slightly positive.

The bottle was filled using the following operating method:

1. Provision of an empty bottle
2. Rinsing of the bottle
3. Transfer of the bottle onto the feedstation
4. Start of cooling of the outer wall of the bottle by spraying with water at 15° C.
   a. filling of the bottle with water at 88° C.
      i. filling time: 8 seconds
      ii. filling volume: 92% of the initial volume, i.e. 979.1 ml.
   b. transfer to the sealing station
      i. duration: 1 s
   c. sealed closure of the bottle
      i. duration of the stopping: 1 s
5. End of cooling of the outer wall of the bottle
6. Shrinkage of the bottle in the open air
   i. shrinkage phase and sterilization
   ii. temperature of the ambient air: 20° C.
   iii. duration: 3 minutes
7. Rapid cooling of the bottle
   i. cooling by spraying with water at 20° C. until the container and its content have returned to ambient temperature.

Example 3

The bottle has a weight of 24 grams and its bottom was of the petaloid type. Its initial volume was 543.2 ml. After filling at 95° C. using the operating method below, its volume became 489.5 ml. The bottle therefore shrank by 9.89% during filling. After cooling, the relative pressure inside the bottle was slightly positive.

The bottle was filled using the following operating method:

1. Provision of an empty bottle
2. Rinsing of the bottle
3. Transfer of the bottle onto the feedstation
4. Start of cooling of the outer wall of the bottle by spraying with water at 5° C.
   a. filling of the bottle with water at 95°
      i. filling time: 4 seconds
      ii. filling volume: 92% of the initial volume, i.e. 499.7 ml.

b. transfer to the sealing station
i. duration: 1 s
c. sealed closure of the bottle
i. duration of the stoppering: 1 s
5. End of cooling of the outer wall of the bottle
6. Shrinkage of the bottle in the open air
i. shrinkage phase and sterilization
ii. temperature of the ambient air: 20° C.
iii. duration: 3 minutes
7. Rapid cooling of the bottle
i. cooling by spraying with water at 20° C. until the container and its content have returned to ambient temperature.

Example 4

The bottle has a weight of 46 grams and its bottom was of the petaloid type. Its initial volume was 1556 ml. After filling at 88° C. using the operating method below, its volume became 1503.8 ml. The bottle therefore shrank by 3.4% during filling. After cooling, the relative pressure inside the bottle was slightly positive.

The bottle was filled using the following operating method:
1. Provision of an empty bottle
2. Rinsing of the bottle
3. Transfer of the bottle onto the feedstation
4. Start of cooling of the outer wall of the bottle by spraying with water at 5° C.
a. filling of the bottle with water at 88°
i. filling time: 6 seconds
ii. filling volume: 92% of the initial volume, i.e. xxx ml.
a. transfer to the sealing station
i. duration: 1 s
b. sealed closure of the bottle
i. duration of the stoppering: 1 s
5. End of cooling of the outer wall of the bottle
6. Shrinkage of the bottle in the open air
i. shrinkage phase and sterilization
ii. temperature of the ambient air: 20° C.
iii. duration: 3 minutes
7. Heating of the side walls of the bottle with hot air (400° C.)
i. shrinkage of the walls of the bottle
ii. the pressure inside the bottle increases
8. Rapid cooling of the bottle Cooling by spraying with water at 20° C. until the container and its content have returned to ambient temperature.

Example 5

The bottle has a weight of 46 grams and its bottom was of the petaloid type. Its initial volume was 1556 ml. After filling at 98° C. using the operating method below, its volume became 1455 ml. The bottle therefore shrank by 6.5% during filling. After cooling, the relative pressure inside the bottle was slightly positive.

The bottle was filled using the following operating method:
1. Provision of an empty bottle
2. Rinsing of the bottle
3. Transfer of the bottle onto the feedstation
4. Start of cooling of the outer wall of the bottle by spraying with water at 5° C.
a. filling of the bottle with water at 98°
i. filling time: 6 seconds
ii. filling volume: 92%
b. transfer to the sealing station
i. duration: 1 s
c. sealed closure of the bottle
i. duration of the stoppering: 1 s
5. End of cooling of the outer wall of the bottle
6. Shrinkage of the bottle in the open air
i. shrinkage phase and sterilization
ii. temperature of the ambient air: 20° C.
iii. duration: 3 minutes
7. Rapid cooling of the bottle
i. Cooling by spraying with water at 20° C. until the container and its content have returned to ambient temperature
8. Heating of the side wails of the bottle with hot air (400° C.)
i. shrinkage of the walls of the bottle
ii. the pressure inside the bottle increases

The invention claimed is:

1. A process for filling a plastic container having walls and having a high degree of molecular orientation with a liquid, which process comprises the following steps:
filling of the container with a liquid at high temperature;
cooling the walls of the container during the filling step;
sealing of the container;
cooling of the walls of the container during the sealing step;
passive shrinkage of the container following said sealing step; and
cooling of the walls of the container following the shrinkage step.

2. The according to claim 1 in which one part of the walls of the container is cooled.

3. The process as claimed in claim 1, in which the walls of the container are at least partly heated after the sealing step.

4. The process as claimed in claim 1, in which a gas, such as nitrogen or carbon dioxide, is added to the container after the filling step and prior to the sealing step.

* * * * *